United States Patent [19]

Yamamoto et al.

[11] 4,123,352

[45] Oct. 31, 1978

[54] APPARATUS FOR DETECTING FLAWS IN CIRCULAR TABLET

[75] Inventors: Masao Yamamoto, Amagasaki; Sumio Iwanaga, Takatsuki, both of Japan

[73] Assignee: Shionogi & Co., Ltd., Osaka, Japan

[21] Appl. No.: 651,236

[22] Filed: Jan. 22, 1976

[30] Foreign Application Priority Data

Feb. 21, 1975 [JP] Japan ..... 50-22165

[51] Int. Cl.[2] ..... B07C 5/342

[52] U.S. Cl. ..... 209/546; 209/630; 209/632; 209/703; 209/588

[58] Field of Search ..... 209/73, 123, 112, 111.7

[56] References Cited

U.S. PATENT DOCUMENTS

| | | | |
|---|---|---|---|
| 703,320 | 6/1902 | Tatham | 209/112 |
| 2,115,032 | 4/1938 | Miller, Jr. et al. | 209/112 X |
| 2,331,478 | 10/1943 | Kellogg | 209/112 |
| 3,785,487 | 1/1974 | Spencer | 209/90 X |

*Primary Examiner*—Allen N. Knowles

*Attorney, Agent, or Firm*—Birch, Stewart, Kolasch and Birch

[57] ABSTRACT

Self-rotating and travelling tendency of a circular tablet in its erect posture along an inclined transferring path and an impeding effect upon the tendency which occurs when the tablet is defective one having a breakage or a speckle, are advantageously utilized by the present invention for detecting flaws in tablets and for discriminating the defective tablets from normal ones.

Transferring path bridging equipment in a tablet processing line, is usually composed of a parallel but spaced pair of rails having shoulders on right opposed faces thereof and upper side plates above said shoulders. The shoulders are capable of carrying the tablets thereon or therein between and having an inclination sufficient for giving the normal tablet a self-rotating and travelling tendency along the path in a given direction. The upper side plates are capable of permitting unobstructed passage of the tablet in its erect posture but make it stagnate on the path in a reclined posture.

10 Claims, 13 Drawing Figures

APPARATUS FOR DETECTING FLAWS IN CIRCULAR TABLET

BACKGROUND OF THE INVENTION

1. Field of the Invention

The present invention generally relates to the detection of flaws in finished circular tablets which may be coated or uncoated. Particularly, it is concerned with a method for discriminating defective tablets from normal (non-defective) ones to discard or to process again the former ones, and an apparatus used for performing said method. It therefore enables the classification of the finished tablets during their travel along a transferring path bridging various equipment in a tablet processing line which may include a tabletting press, a coating pan, a polishing machine and a wrapping machine.

Finished tablets may occasionally be broken or specked by possible collision with respect to other tablets or other parts or components of any equipment during their transferring operations to any subsequent processing step, for instance, the coating or wrapping step. These flaws occur particularly on the circular edge lines of the tablets and the modes thereof may generally be classified into the following two modes according to the degree or the magnitude of the flaws.

These are elucidated in FIG. 1 of the drawings; one shown in FIG. 1A, wherein the plane shape of the tablet, i.e., the shape projected onto a plane vertical to the direction of pressing operation of the tablet, is no longer a circle with a broken part or parts, is referred to as a broken one, and that shown in FIG. 1B, wherein the body of the tablet is partly broken but its plane shape still remains a complete circle, is referred to as a specked one throughout this specification and claims. It is to be noted herein that a tablet having an elliptical section (for instance, a sugar-coated tablet) shown in FIG. 1C, is apt to be injured at its tapered but rounded circumferential edge, and the modes thereof may likewise be classified.

Such flaws may occur by various other causes in the tablet processing line and the frequency of their occurence is extremely low, i.e., in the order of from one five hundred thousandth (1/500,000) to one two million and five hundred thousandth (1/2,500,000). Although the frequency is extremely low, these defective tablets must imperatively be removed from the bulky lot of tablets, before they enter the subsequent steps, for example, a wrapping step, and therefore an operation for detecting such broken or specked tablets to classify and discriminate them from the normal ones must be interposed between the preceding step and the subsequent step.

2. Description of the Prior Art

Hithertofore, this operation has been performed by a mechanical method of introducing the tablet to be inspected into a vibrating sieve composed of a punched metal screen having perforations of a diameter of corresponding magnitude and by removing away the defective tablets through the perforations, and/or a non-mechanical method of visual inspection with human eyes of a plurality of inspectors.

According to the former method, i.e., the screening method, this itself is defective because broken or specked tablets cannot occasionally pass through the perforations of the sieve or screen but remain thereon, if a plane breadth of such tablet still remains identical to that of the normal tablet. In other words, if such tablets have a plane breadth larger than one second ($\frac{1}{2}$) of that of the normal one (all specked tablets have a plane breadth larger than one second ($\frac{1}{2}$) of that of the normal ones as defined above), the broken or specked tablets may often be transferred to any subsequent steps together with the normal ones without being removed.

The latter method, i.e., visual inspection by human's eyes, is also very difficult to perform properly, because the number of the tablets transferred through a tablet processing line, usually by a belt-conveyer, exceeds a rate of 1000–3000 tablets per minute and the inspecting operation must extend to very small specks. Furthermore, this method has another disadvantage in that it can only be performed properly on either side of the tablet at one time and enough inspection cannot be performed on the other side. Moreover, errors due to fatigue of the eyes of the inspector must not be disregarded.

SUMMARY OF THE INVENTION

Now, the present inventors have found that the defective tablets show peculiar behaviours in their rotation on flat and smooth plane as compared with that of the normal tablet, and that such defective tablets can be discriminated from the normal ones by detecting this peculiarity or abnormality in the rotating tendency to lead to the present invention by embodying the method and apparatus capable of permitting the tablets to exhibit this abnormal behaviour most characteristically.

It is therefore the primary object of the present invention to provide a method for detecting flaws in finished circular tablets.

It is another object of the present invention to provide a method for discriminating defective tablets having a breakage or a speckle from normal ones in a bulky lot of tablets with ease and accuracy.

It is further object of the present invention to provide an improved apparatus for performing said method most effectively with minimum possibility of overlooking defective tablets.

These and other objects of the present invention and attendant advantages thereof will in part be obvious and will in part be made apparent to those who are conversant with the art to which the present invention pertains.

Almost all of these objects are attained by a method for detecting flaws in circular tablets which comprises; aligning tablets to be inspected in a single row, transferring the tablets through a path having an ability of carrying the tablet in its erect posture thereon or therein between, and an inclination sufficient for giving the tablet a self-rotating tendency through the path if the tablet is a normal one but giving the tablet a stagnating tendency on the path if the tablet is a defective one, and removing the stagnated one from the path.

In another aspect of the present invention, there is also provided an apparatus for performing said method which comprises: a transferring path bridging equipment in tablet processing line, composed of a parallel but spaced pair of rails having shoulders on right opposed faces thereof capable of carrying the finished tablet to be inspected in an erect posture there or therein between, the parallel lines of the shoulders having an inclination with respect to horizontal plane sufficient for giving a normal tablet being carried a self-rotating and travelling tendency along a given direction through the length of the path, and upper side plates above said shoulders capable of permitting unobstructed passage of the travelling tablet in its erect posture but making it stagnate on the path in its reclined posture.

BRIEF DESCRIPTION OF THE DRAWINGS

In describing the preferred embodiments, references will be made to the accompanying drawings, in which:

FIGS. 5A and 5B are sections like FIGS. 4A and 4B, of variations of the transferring paths, and FIGS. 6A–6D each represents sections of the transferring path, wherein the modes of carriage of the tablet shown in schematic on the path and the fate of fragments of tablet or other small particles are illustrated.

In the following paragraphs, the description will primarily be directed to the embodiment shown in the drawings, wherein the parts or components having identical functions are designated by the same or similar reference characters or numerals throughout several views.

PREFERRED EMBODIMENT OF THE INVENTION

Figure 3:
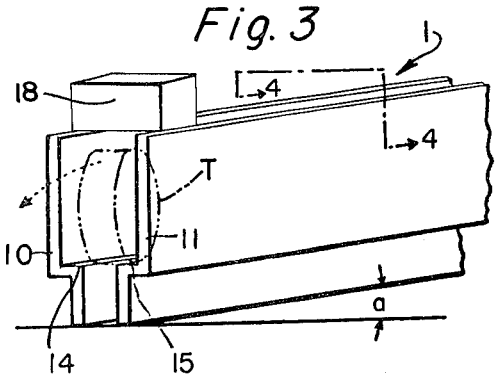

The apparatus used for the method of the present invention comprises, as its essential component, a transferring path 1 composed of a pair of parallel rails 10, 11 shown in FIGS. 3 and 4. The rails have shoulders 14, 15 formed integrally with the body of the rails on right opposed faces thereof, capable of carrying finished circular tablets T (shown by the broken line) to be inspected, aligned in a single row thereon, and upper side plates 12, 13 surrounding the both sides of the tablets. The shoulders 14, 15 are arranged to have an inclination ($\alpha$) with respect to the horizontal plane sufficient for giving the tablets a self-rotating tendency if they are normal ones.

Figure 4A:
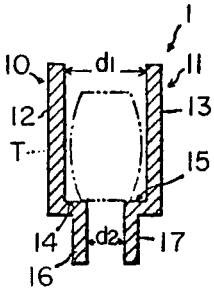

The path is usually designed such that the clearance $d_1$ between upper side plates 12, 13 is slightly larger than the maximum thickness of the tablet T, i.e., the thickness of the center of the tablet, and the clearance $d_2$ between the corners of the shoulders 14, 15 is slightly smaller than the minimum thickness of the tablet T, i.e., the thickness of the circumference of the tablet. (FIG. 4A).

Figure 4B:
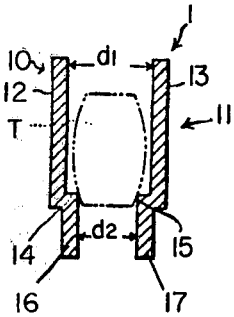

Alternately, the section of the rail may be designed such that said clearance $d_2$ is slightly larger than the minimum thickness of the tablet T but slightly smaller than the maximum thickness thereof (FIG. 4B). Moreover, the clearance between the shoulders may be designed variable throughout its length so that the shoulders can come into contact with a plurality of the circumferential edges of, for instance, a sugar-coated tablet having a cross section of an ellipse and a tapered but rounded edge.

Of the components of the path, the lower side plates 16, 17 of the rails are, of course, not essential for the function of the apparatus and therefore may be omitted when required or may be formed in any other shape. However, the shoulders 14, 15 must be formed as sharp corners of dihedral angles regardless of their sharpness, i.e., whether the angle are acute or obtuse (in the embodiment shown in FIGS. 3 and 4, the named corners are right angle).

Furthermore, although the sections of the shoulders 14, 15 should always be symmetrical, their upper faces may not necessarily be formed flat but may be leaned inwards or outwards as shown in section in FIGS. 5A and 5B, wherein the corner angles of acute and obtuse are shown.

These leaned faces may be designed to accomodate the section of the tablet to be inspected to adjust the accuracy or sensitivity of the detection in accordance with the character of operation; naturally, the acute corners are more sensitive than the obtuse ones, but excessive sensitivity may not be practically required and sometimes may be detrimental for the purpose.

Therefore, the tablet T carried on the path in its erect posture is usually held by the shoulders 14, 15, particularly on their corners at the vicinities of tablet's circular edges (See, FIGS. 4A, B). FIG. 4B shows an embodiment wherein the erect tablet T gets in and is placed between the corners of the shoulders 14, 15 at its circular edge in somewhat a hanging position.

Figure 2:
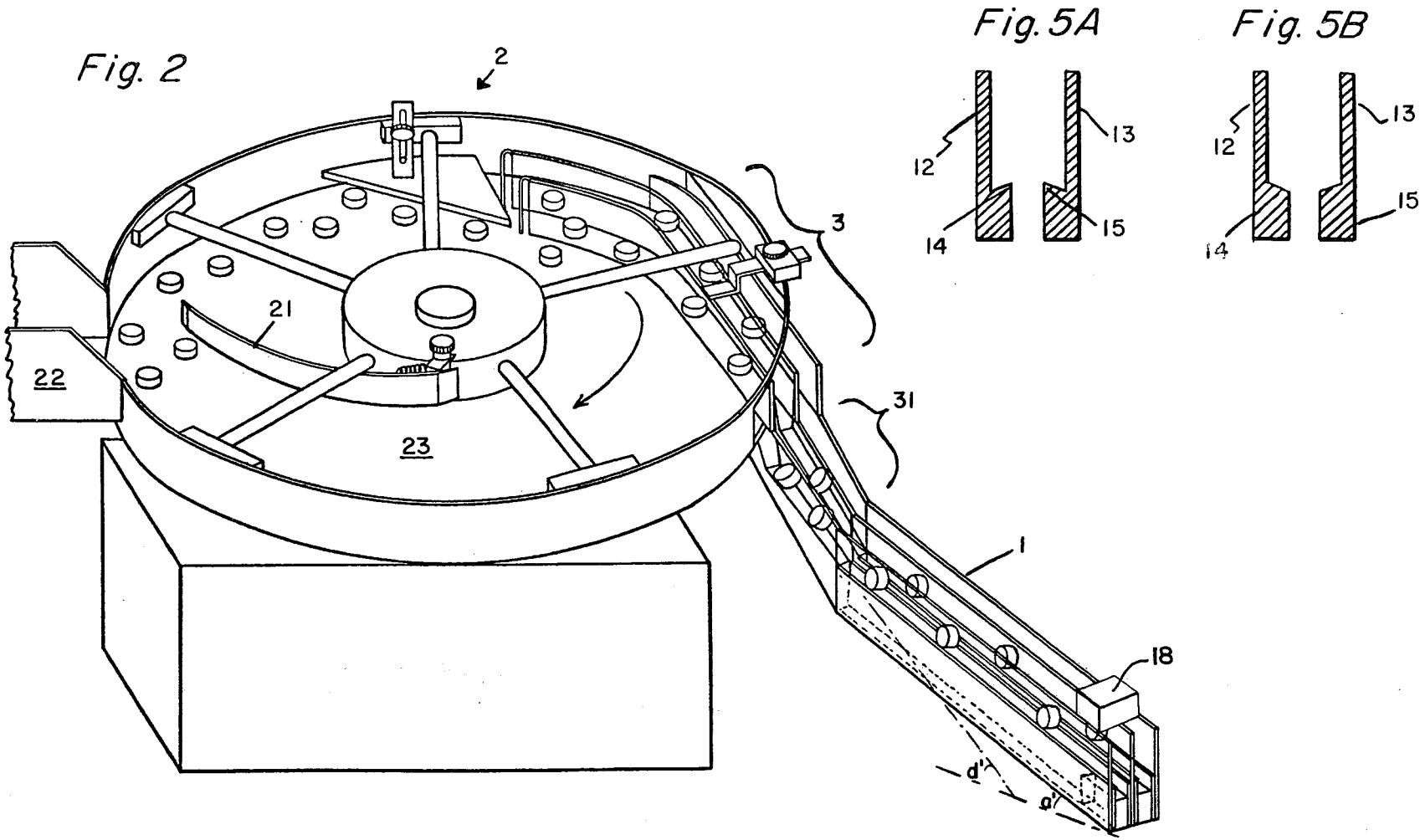
FIG. 2 is a schematic perspective of one embodiment of the present invention combined with ancillary devices, wherein the transferring path combined with an aligning device are composed of transparent material in order to enable one to examine states of the tablet in seeing-through, FIG. 3 is a schematic of a portion of the transferring path of the embodiment shown in FIG. 2, FIGS. 4A and 4B are sections cut along the line 4—4 of FIG. 3.

Another function of the path "Having an inclination sufficient for giving the tablets a self-rotating and travelling tendency" may be fulfilled by so designing the path that it is inclined along its length. In the embodiment, the path, as a whole, is positioned aslant against a horizontal plane as shown in FIGS. 2 and 3. This can alternately be fulfilled by making only the shoulders 14, 15 of the rails 10, 11 have such slope.

As previously described, the angle $\alpha$ of the inclination of the transferring path which gives the tablets T, a self-rotating and travelling tendency in their erect postures, may be very small and this small angle is sufficient for this purpose because the tablets to be inspected are circular ones and ready to rotate on any smooth surface, but should not be excessive in view of the purpose of the present invention.

Namely, if the transferring path is excessively sloped, discrimination of the defective tablets from the normal ones cannot occasionally be performed with sufficient accuracy because the excessive slope of the transferring path gives the tablet a rotating moment which is too intense to stop it even if the tablet is actually defective but forces the tablet to rotate along said path as if it is a normal one.

On the contrary, too moderate an angle of the inclination gives the tablet too small moment of rotation and raises the accuracy of the discriminating operation on the basis of the nature of the invention, but drastically lowers its capacity of classification because of the lower transferring speed. In addition to this, a too moderate angle of inclination may occasionally cause a bridging of two or more tablets in the path, that is, even normal tablets may stagnate in this section.

Although it is therefore desirable to select the angle $\alpha$ of the inclination empirically while maintaining an adequate balance between the accuracy in the detection and the capacity of classification, an angle of from 2° to 9°, especially, that of from 4° to 7°, is generally preferred.

In a practical embodiment of the present invention, a transferring path having two slopes is preferably employed. An inlet portion of the path has an inclination sufficient for avoiding stagnation of tablet due to bridging of two or more tablets, which is larger than that of the remainder of the path where the inclination is moderate enough to insure accurate detection of flaws in tablets.

The length of the transferring path 1 should be long enough to stop the rotating movement of the defective tablets while they are travelling along the path, and there is no particular limitation. Practically, a length of from 0.5 to 2 meter might be appropriate in view of the applicability of this apparatus with respect to any other equipment already installed and to plant layout.

As obvious from the above disclosure, the transferring path may be made of any suitable material having a smooth surface with adequate friction, such as from polymeric materials and metals, and may be processed as mouldings.

The transferring path 1 shown in FIG. 3, composed of parallel rails may be formed by simply joining two separate rails 10, 11 in a pair in a faced arrangement wherein the clearances between the faced side plates and shoulders must be selected in compliance with the thickness of the tablet to be inspected.

Although not specifically illustrated in the drawings, the path may alternately be formed of two rails integrally with suitable connecting members at any positions of the rails unless they hinder the passage of tablets but must be formed bottomless to discard small particles or fragments of tablet.

In the following, the operation and advantages of the apparatus will be discussed in detail.

When finished circular tablets T in their erect posture, aligned in a single row, are supplied continuously from the inlet portion of the transferring path 1 positioned with a suitable inclination $\alpha$ with respect to the horizontal plane, the tablet T is carried on the corners of the parallel shoulders 14, 15, and begin their self-rotating movements along the inclination of the transferring path.

This supplying operation may be performed automatically by, for instance, connecting an electromagnetic feeder or a rotating feeder to the inlet portion of the transferring path through a chute equipped with guiding grooves capable of bringing the reclining tablets into their erect postures.

One such example of ancillary equipment is shown in FIG. 2, wherein a vane 21 of a rotating feeder 2 guides the tablets supplied from a hopper 22 at the left extreme side and are carried on a turntable 23 which rotates in the direction of the arrow to an aligning device 3 at the opposite side. A portion of the aligning device 3 which extends tangentially from the circumference of the feeder 2 to serve as an inlet portion 31 of the transferring path 1, also plays a role in erecting tablets and then of giving said tablets an initial rotating movement, and therefore has a larger angle of inclination ($\alpha'$) for fulfilling this purpose.

If the tablet T which is being carried on the path 1 is a normal one, it travels by self-rotating action along the inclined path without stopping to its other end without any disturbance, because its initial erect posture is maintained throughout the travel and the upper side plates permit an unobstructed passage. (FIG. 6A)

Figures 6A, 6B, 6C, 6D:
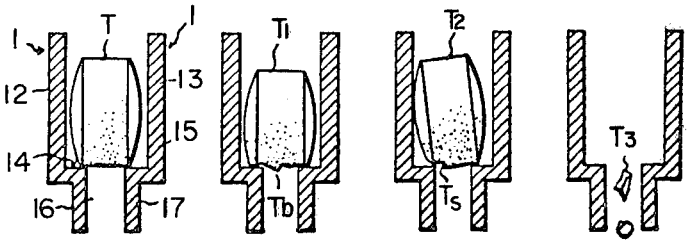

On the contrary, if the tablet is a broken one $T_1$, the broken portion $T_b$ thereof rests on the corners of the shoulders 14, 15 to increase the contacting resistance between the tablet and the rails, and eventually to stop the tablet T, on the path as shown in FIG. 6B. If the tablet is a specked one $T_2$, the specked portion $T_s$ thereof rests or hangs on either one of the corners to make the tablet recline on either side of the rail and sometimes on the walls of the upper side plates 12, 13 to increase its contacting resistance against such components, and eventually stops the tablet $T_2$ on the transferring path as in the case of the broken tablet $T_1$. (FIG. 6C)

The above illustration is made in accordance with an embodiment shown in FIG. 3A, but is extendable to the case shown in FIG. 3B wherein the stability of the erect posture of the tablet is enhanced because the circular edge line of the tablet in its erect posture is getting in between the corners of the parallel rails, but the phenomenon of stopping is identical to the case illustrated by FIG. 6.

Figure 1A:
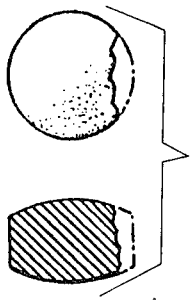
FIGS. 1A, 1B and 1C each represents a plan view or typical views and its section (immediately below the plan) of defective tablet wherein the broken or specked portions are designated by imaginary broken lines.
Figure 1B:
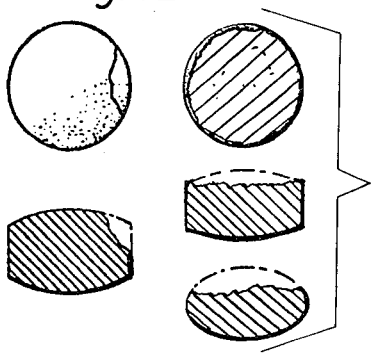
Figure 1C:
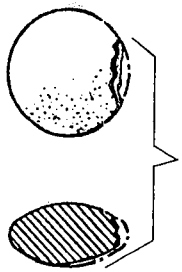

It is to be noted that if the tablet is, for instance, a sugar coated tablet having an elliptical cross section as shown in FIG. 1C, it is necessary to design the rails as shown in FIG. 4B, and in such case small speckles distributed widely over the face of its tapered but rounded circumferential edge can be detected sufficiently, by varying the clearance $d_2$ between the corners of the shoulders along its length, so that said corners can contact with a plurality of the circumferential edge lines of the tablet.

Incidentally, no regularity as regards the mode of stopping of the defective tablet has however been found. How the tablet on the transferring path is to stop is entirely attributable to the mode of flaw itself, and therefore, in contrast to the above illustration, the broken tablet may occasionally be stopped in the state shown in FIG. 6C, and the specked one may stop in that shown in FIG. 6B.

Some of the defective tablets recline against the side plates 12, 13 above the shoulder 14, 15 to increase the contacting resistance with the plates so as to stagnate, but others may stop without contacting either of the plates.

In any event, any defective tablets having breakage or speckles stop and become an obstruction without exception on the transferring path of the equipment built in accordance with the present invention, which may further have an ability of utilizing the phenomenon of the stoppage to classify the tablet without any difficulty.

As a matter of fact, any normal tablets which are travelling along the transferring path in succession to the defective tablet, may of course be blocked by this obstruction and stagnate on the path as a row headed by the defective tablet, but may begin to rotate by themselves again with the removal of the defective tablet which leads the succession.

The broken piece $T_3$ and the like small particles which do not remain on the rails, fall down through the clearance $d_2$ between the parallel rails and are collected in a container positioned below the rails which is not specifically shown in the drawings. (FIG. 6D)

As previously described, the discrimination of the defective tablets having breakages or speckles from the normal tablets may be performed with high accuracy and without any difficulty by employing the equipment built in accordance with the present invention, because the equipment is capable of sensing the phenomenon that the defective tablet stops their self-rotating movement and makes a stagnated row of the normal tablets in succession to the defective one very correctly. The equipment of the present invention has, therefore, a great advantage for facilitating the inspection operation of this kind because it relieves the operator from a burden of being bound to a machine. The only thing he must do is to sense the stagnation by any warning device represented by element 18, and to simply remove stopped defective tablet from the transferring path to dissolve the stagnation of normal tablets which have been in succession to the defective tablet.

For the equipment of the present invention, any means for detecting and removing the stagnated tablet can be applicable. Although the operation may be performed manually, the stagnation may automatically be detected by a photoelectrical means, represented by element 18, and may be removed by an automatic means which may include an electromagnetic solenoid actuatable by a signal derived from the photoelectrical sensing means.

Employment of such automatic mechanism is particularly advantageous for effective operation as well as for the saving of man-power.

A plurality of the transferring paths usually in parallel may advantageously be installed in one unit of the apparatus of this invention, wherein the finished circular tablets to be inspected must be aligned in a single row for each of the paths and carried thereon in their erect posture in order to be given a self-rotating tendency, because a single transferring path having a main inclination $\alpha$ of about 4°–7° can process the tablets satisfactorily in the order of only about 500–1000 tablets per minute.

In the following, the performance of the present invention will be supported by way of particulars of the experiments:

Experiments

Transferring path:

(i) Material: Stainless steel.

(ii) Length: 800 mm.

(iii) Clearance $d_1$ between upper side plates: 5.4 mm.

(iv) Clearance $d_2$ between shoulders: 3.4 mm.

(v) Corner angle of the shoulders: 90° (upper face of shoulder: flat)

Tablets to be inspected:

(i) Diameter: 9.03 mm.

(ii) Maximum thickness: 4.10–4.25 mm.

(iii) Minimum thickness: 2.30–2.45 mm.

(iv) Weight: 2.64–2.79 mg.

(v) Surface: Uncoated plain tablet.

The tablets to be inspected of a lot size of 600 thousand are aligned in a single row and supplied to inlet portion of the above described transferring path in their erect postures in order to confirm the modes of stoppage of defective tablets. This lot includes one thousand of specked tablets with speckles of 5 weight percent and the same numbers of such tablets with speckles of 3 weight percent, respectively. The tablets travel by rotation along the path at an interval of about 1–2 cm.

Results of the experiments are tabulated as follows:

| Extent of defect (speckle) % wt. | Inclination of the transferring path (degree) | Tablets stopped on the path | Rate of detection (%) |
|---|---|---|---|
| 5 | 4–9 | 1000 | 100 |
| 5 | 10 | 980 | 98 |
| 3 | 4 | 1000 | 100 |
| 3 | 5–7 | 900–950 | 90–95 |

-continued

| Extent of defect (speckle) % wt. | Inclination of the transferring path (degree) | Tablets stopped on the path | Rate of detection (%) |
|---|---|---|---|
| 3 | 10 | 700 | 70 |

The above experimental results revealed that, as far as the angle of inclination of the transferring path is maintained below 4°, the apparatus of the present invention is capable of inspecting 100% of specked tablets having speckle of as small as 3 weight percent, and if the weight of speckle should increase up to 5 percent, 100% of the specked tablets would be detected regardless of the increase in the inclination angle up to 9°.

Although the foregoing disclosures have primarily been restricted the application of the present invention to that of the treatment of generally circular tablet because of the simplicity of elucidation, the term "circular" does neither necessarily mean a genuine circle nor exclude any other shapes which approximate to a circle.

On the contrary, the disclosed method and apparatus of detecting flaws in tablet and classifying tablets into normal ones and defective ones, can be applicable to non-circular tablet having elliptic profiles, so far as it can rotate along the transferring path and the path itself has an ability of giving the normal elliptic tablet a self-rotating tendency.

The elliptic tablet rotates along the path by repeating gentle rises and falls, and its loci depicted by connecting various points of the normal tablet in rotation are complex spirals or helixes which may sometimes be compound hypocycloids, but inertia given by the adequately chosen inclination of the path can sufficiently serve to continue the rotation.

Any flaws and distortions of the defective tablet are sufficient to hinder and discontinue this rotation and to make the tablet stagnate on the path, and the modes of stoppage are similar to those already described. According to another experiment performed by the present inventors for detecting distorted tablets from a bulky lot of sugar coated elliptic tablets, normal ones having a long diameter of 14.4 ± 0.2 mm, a short diameter of 9 ± 0.1 mm, a thickness of 6.9 ± 0.1 mm and a weight of 873 ± 5 mg can rotate along a transferring path which is similar to that already described but has clearances $d_1$ of 8.8 mm and $d_2$ of 6.8 mm and a main inclination of 7°, whereas the distorted ones unexceptionally failed to rotate and stopped on the path.

What is claimed is:

1. An apparatus for detecting flaws in tablets having a circular cross-section, which comprises: a transferring pathway adapted to bridge equipment in a tablet processing line including a parallel spaced pair of rails having shoulders on opposed faces thereof capable of carrying the tablets with the circular cross-section thereof substantially upright, said pathway being arranged so that the parallel lines of the shoulders have an inclination with respect to the horizontal sufficient to impart to a normal tablet being carried a self-rotating and travelling tendency along the pathway, and side plates above the shoulders capable of permitting unobstructed passage therebetween of travelling tablets with the circular cross-section thereof substantially upright and adapted to prevent smooth passage of defective tablets in a position diverging substantially from an upright position.

2. An apparatus as claimed in claim 1, wherein the shoulders comprise the sharp corners of a dihedral angle containing flat upper faces capable of carrying the tablets thereon.

3. An apparatus as claimed in claim 2, wherein the upper faces are disposed so as to form a dihedral angle with the side plates throughout their length.

4. An apparatus as claimed in claim 1, wherein the shoulders comprise the sharp corners of a dihedral angle, the clearance between said corners being greater than the minimum thickness of a tablet but slightly smaller than the maximum thickness thereof so that they are capable of holding the tablet therebetween in a hanging posture.

5. An apparatus as claimed in claim 4, wherein the clearance between the sharp corners varies through out their length so that the sharp corners can come into contact with a plurality of loci on the faces of the tablet.

6. An apparatus as claimed in claim 1, wherein both rails have a substantially uniform and symmetrical cross-section throughout their length and are arranged at a slant with respect to the horizontal plane as a whole.

7. An apparatus as claimed in claim 6, wherein an inlet portion of the path has an inclination sufficient for avoiding stagnation of tablets due to bridging of two or more tablets and therefore larger than that of the remainder of the path where the inclination is moderate enough to insure accurate detection of flaws.

8. An apparatus as claimed in claim 6, wherein the inlet portion of the path comprises a first twisted path capable of erecting the laid tablet and a second straight path capable of giving the erected tablet an initial rotating movement.

9. An apparatus as claimed in claim 1, wherein there is provided a means capable of sensing the stoppage of a tablet on the transferring pathway.

10. An apparatus as claimed in claim 9, wherein the means is a photoelectrical means capable of supplying an electric signal.

* * * * *